US007259343B1

(12) United States Patent
Huang

(10) Patent No.: US 7,259,343 B1
(45) Date of Patent: Aug. 21, 2007

(54) SAFETY SWITCH

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 0 days.

(21) Appl. No.: 11/522,360

(22) Filed: Sep. 18, 2006

(51) Int. Cl.
*H01H 21/00* (2006.01)

(52) U.S. Cl. ..... 200/553; 200/339; 337/37; 337/66

(58) Field of Classification Search ..... 200/334, 200/553, 557–561, 318, 323–325; 337/36, 337/37, 56, 62, 66, 85, 113
See application file for complete search history.

(56) References Cited

U.S. PATENT DOCUMENTS 5,828,284 A * 10/1998 Huang ..... 337/37
5,933,069 A * 8/1999 Huang ..... 337/66
6,400,250 B1 * 6/2002 Wang ..... 337/66
6,452,125 B1 * 9/2002 Yu ..... 200/553
6,462,292 B1 * 10/2002 Wang ..... 200/315
6,714,116 B1 * 3/2004 Sang et al. ..... 337/68
6,884,955 B1 * 4/2005 Yu ..... 200/553

* cited by examiner

*Primary Examiner*—Michael A. Friedhofer
(74) *Attorney, Agent, or Firm*—Rosenberg, Klein & Lee

(57) ABSTRACT

A safety switch has a casing, a first circuit prong, a second circuit prong, a switch contact, a rocker, an arm and a latch. The first and second circuit prongs are mounted in and extend through the casing. The switch contact bends upward when temperature of the switch contact increases, is mounted on the first circuit prong and has a distal end selectively contacting the second circuit prong. The rocker is pivotally mounted on the casing and has a deactivating end and an activating end. The arm is formed on and protrudes down from the activating end and connects to the distal end of the switch contact. The latch is mounted in the cavity and selectively locks the arm to prevent the distal end of the switch contact from contacting the second circuit prong as the temperature drops. The safety switch may be used in severely cold environments.

17 Claims, 8 Drawing Sheets

SAFETY SWITCH

BACKGROUND OF THE INVENTION

1. Field of the Invention

The present invention relates to a switch, and more particularly to a safety switch that is mounted on a power strip including a power-supplying circuit and is capable of cutting off the power-supplying circuit when circuit current on the power-supplying circuit is too high.

2. Description of Related Art

Electric appliances connect to and obtain power from electrical outlets. However, electrical outlets are usually mounted securely in a wall or floor and cannot be moved. Therefore, an electric appliance having a wire and plug connected to the electrical outlet had to be positioned near the electrical outlet. As the number of electrical appliances proliferated to include lamps, TVs, tape and disk players, stereos, clocks, computers, computer peripherals, etc., electrical outlets in rooms is insufficient to connect multiple electric appliances.

Therefore, a power strip having multiple receptacles and an extended cable was developed. The power strip is connected to an electrical outlet, and multiple electric appliances are connected to the power strip. The extended cable allows an electric appliance to be positioned as desired without being limited by the electrical outlet in the wall. To prevent excessive current from developing in and destroying the power strip when total power consumption of the electric appliances connected to the power strip exceeds a maximum load of the power strip, multiple safety switches are mounted on the power strip and connect respectively to the receptacles.

With reference to FIGS. 7 and 8, a conventional safety switch has a casing (90), a first prong (91), a second prong (92), a switch contact (93) and a rocker (94).

The casing (90) is hollow, is mounted on a power socket and has a top, a bottom and a cavity. The first and second prongs (91, 92) are mounted in the cavity, extend down through the bottom of the casing (90) and are connected to a power-supplying circuit in the power strip. The switch contact (93) is bimetallic, bends upward as temperature of the switch contact (93) increases, is connected to the second prong (92) and has a proximal end and a distal end (931). The proximal end is connected securely to the second prong (92) in the cavity, and the distal end (931) selectively abuts the first prong (91). The rocker (94) is mounted pivotally on the top of the casing (90) and has a first end, a second end and an arm (941). The arm (941) is mounted on the first end of the rocker (94), extends through the top of the casing (90) and is connected to the distal end (931) of the switch contact (93). Pressing the first end of the rocker (94) pushes the arm (941) and the distal end (931) down so the distal end (931) of the switch contact (93) contacts the first prong (91) and activates the power-supplying circuit. When the current in the power-supplying circuit is too high and the temperature of the switch contact (93) increases excessively, the switch contact (93) bends due to the bimetallic characteristic, and the distal end (931) pulls away from the first prong (91) to deactivate the power-supplying circuit.

However, environmental temperature in high latitude areas such as the Temperate Zone and the Frigid Zone is very low and may even be below 0° C. In such a severely cold environment, the temperature of a heated switch contact (93) separated from the first prong (91) due to over current quickly drops and causes the distal end (931) to contact the first prong (91) again after a very short time from the separation of the first and switch prongs (91, 93). Such repetitive contact and separation of the first and switch prongs (91, 93) improperly turns the electric appliances connected to the power strip on and off. The electric appliances and may probably burn out.

To overcome the shortcomings, the present invention provides a safety switch to mitigate or obviate the aforementioned problems.

SUMMARY OF THE INVENTION

The main objective of the invention is to provide a safety switch that is mounted on a power strip including a power-supplying circuit and is capable of cutting off the power-supplying circuit in an over current in the power-supplying circuit.

A safety switch in accordance with the present invention comprises a casing, a first circuit prong, a second circuit prong, a switch contact, a rocker, an arm and a latch.

The first and second circuit prongs are mounted in and extend through the casing.

The switch contact bends the switch contact temperature rises, is connected to the first circuit prong and has a distal end selectively contacting the second circuit prong.

The rocker is mounted pivotally on the casing and has a deactivating end and an activating end.

The arm is formed on and protrudes down from the activating end and connects to the distal end of the switch contact.

The latch is mounted in the cavity and selectively locks the arm to prevent the distal end of the switch contact from contacting the second circuit prong as the temperature of the switch contact drops.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
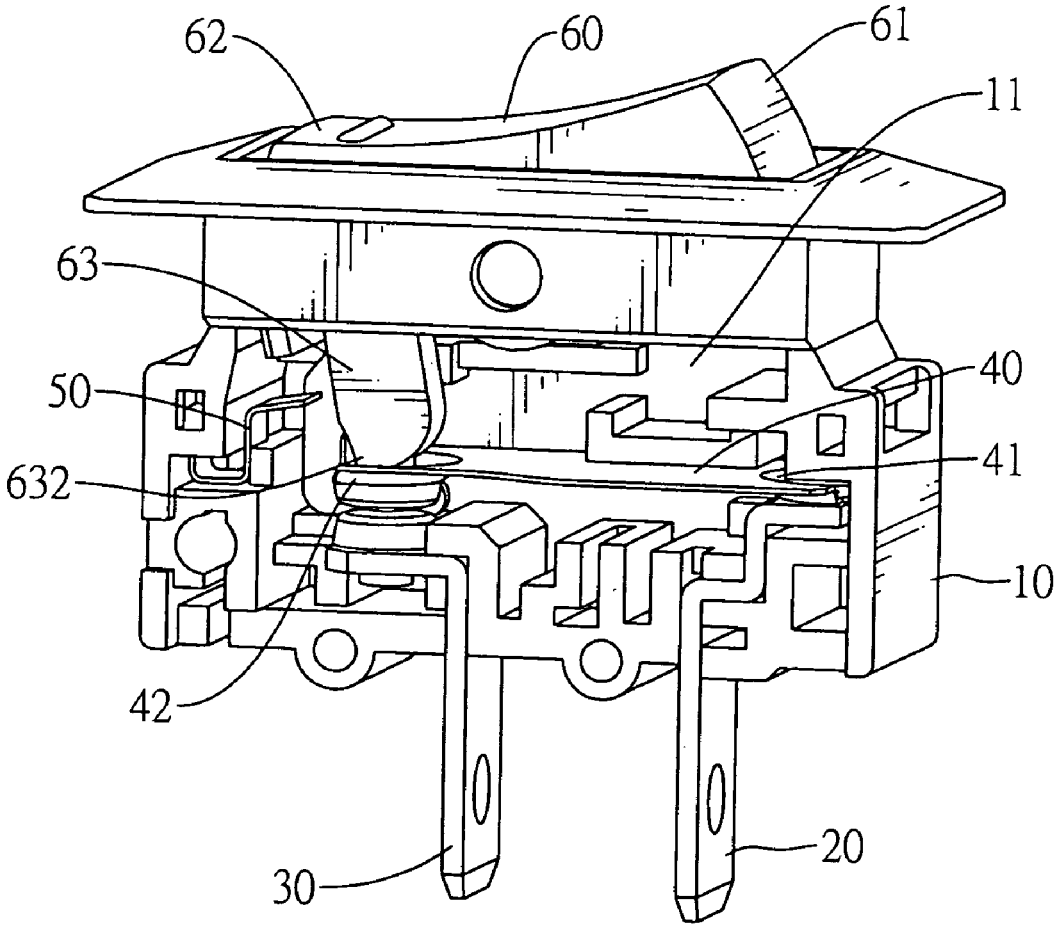
FIG. 1 is a perspective view of a safety switch in accordance with the present invention with the deactivating end of the rocker pressed.
Figure 2:
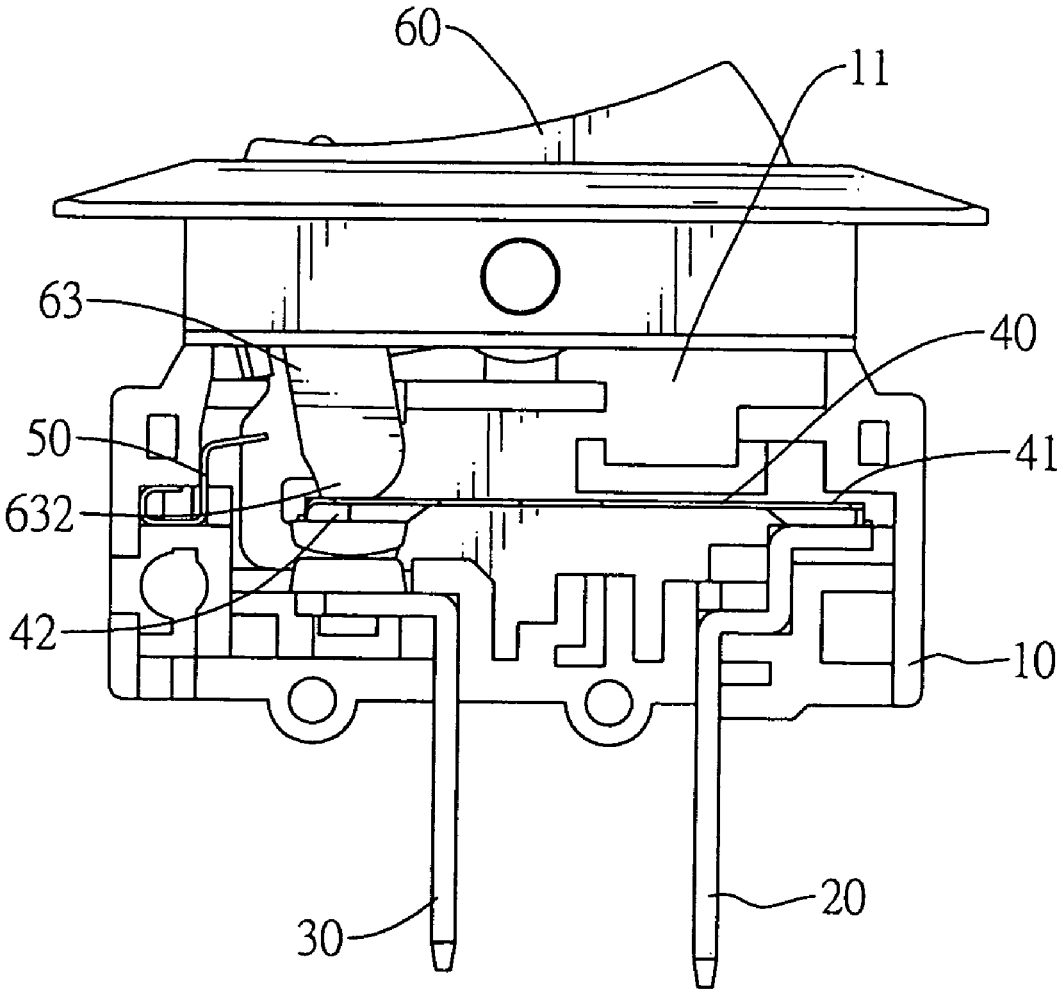
FIG. 2 is a side view of the safety switch in FIG. 1.

With reference to FIGS. 1 and 2, safety switches in accordance with the present invention are mounted on a power strip having a power-supplying circuit and multiple receptacles. The receptacles are mounted on the power strip, connect respectively to the safety switches and may respectively hold power plugs of electric appliances.

Each safety switch comprises a casing (10), a first circuit prong (20), a second circuit prong (30), a switch contact (40), a rocker (60) and a latch (50).

The casing (10) has a top, a bottom and a cavity (11). The cavity (11) is defined in the casing (10).

The first circuit prong (20) is mounted in the cavity (11), extends through the bottom of the casing (10) and electrically connects to the power-supplying circuit in the power strip.

The second circuit prong (30) is mounted in the cavity (11), extends through the bottom of the casing (10) parallel to the first circuit prong (20) and electrically connects to the power-supplying circuit in the power strip.

The switch contact (40) may be bimetallic or material with memory, bends upward as temperature of the switch contact (40) increases, is attached to the first circuit prong (20) and has a proximal end (41) and a distal end (42). The proximal end (41) is attached securely to the first circuit prong (20). The distal end (42) selectively contacts or separates from the second circuit prong (30). The switch contact (40) bends upward and the distal end (42) moves away from the second circuit prong (30) as the temperature of the switch contact (40) increases. The switch contact (40) bends downward and the distal end (42) moves toward the second circuit prong (30) as the temperature of the switch contact (40) decreases.

Figure 3:
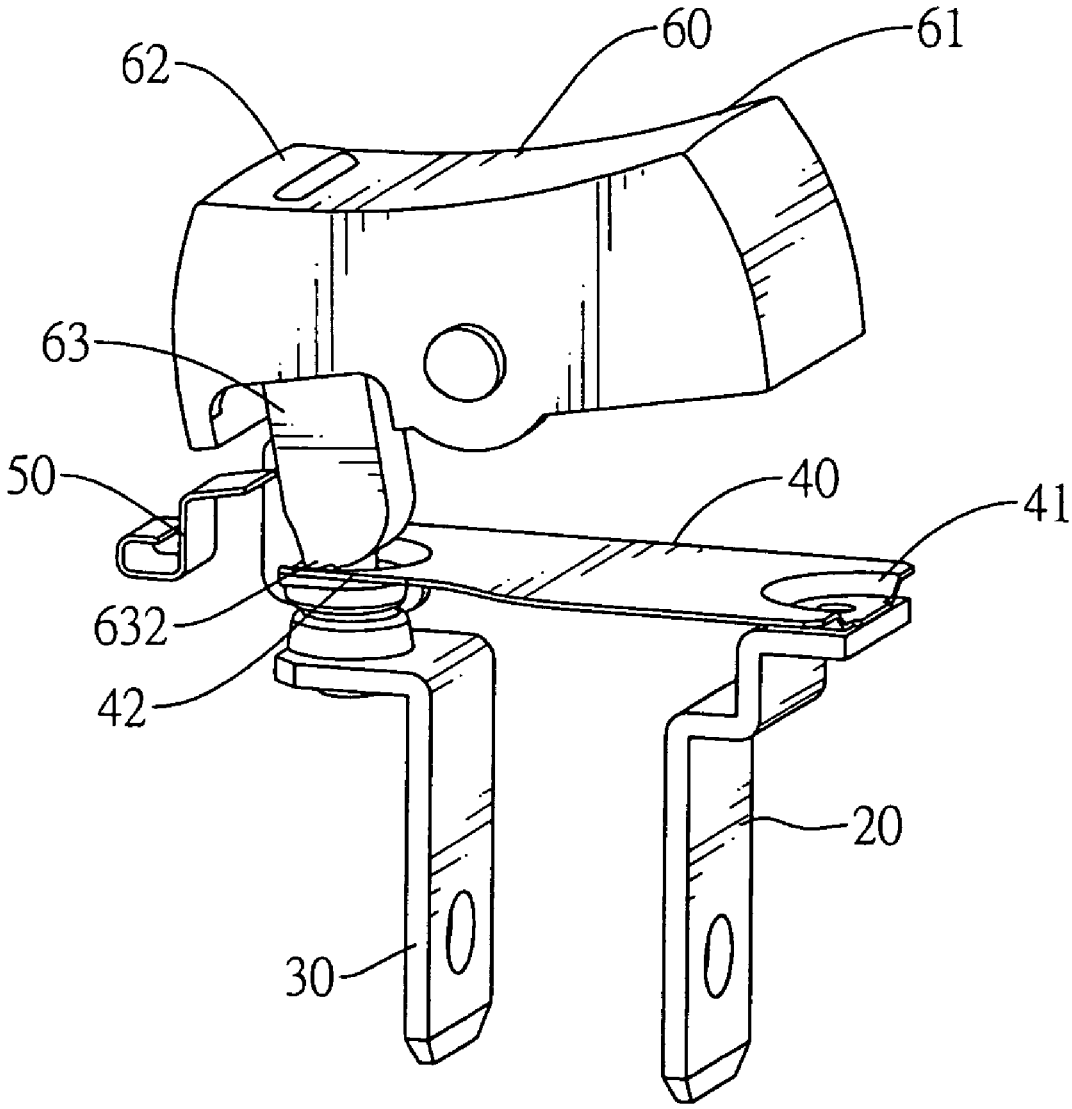
FIG. 3 is a perspective view of the safety switch in FIG. 1 without the casing.

With further reference to FIG. 3, the rocker (60) is mounted pivotally on the top of the casing (10) and has a deactivating end (61), an activating end (62) and an arm (63). The arm (63) is formed on and protrudes down from the activating end (62), extends through the top of the casing (10) into the cavity (11) and has a distal end (632). The distal end (632) connects to the distal end (42) of the switch contact (40).

Figure 4:
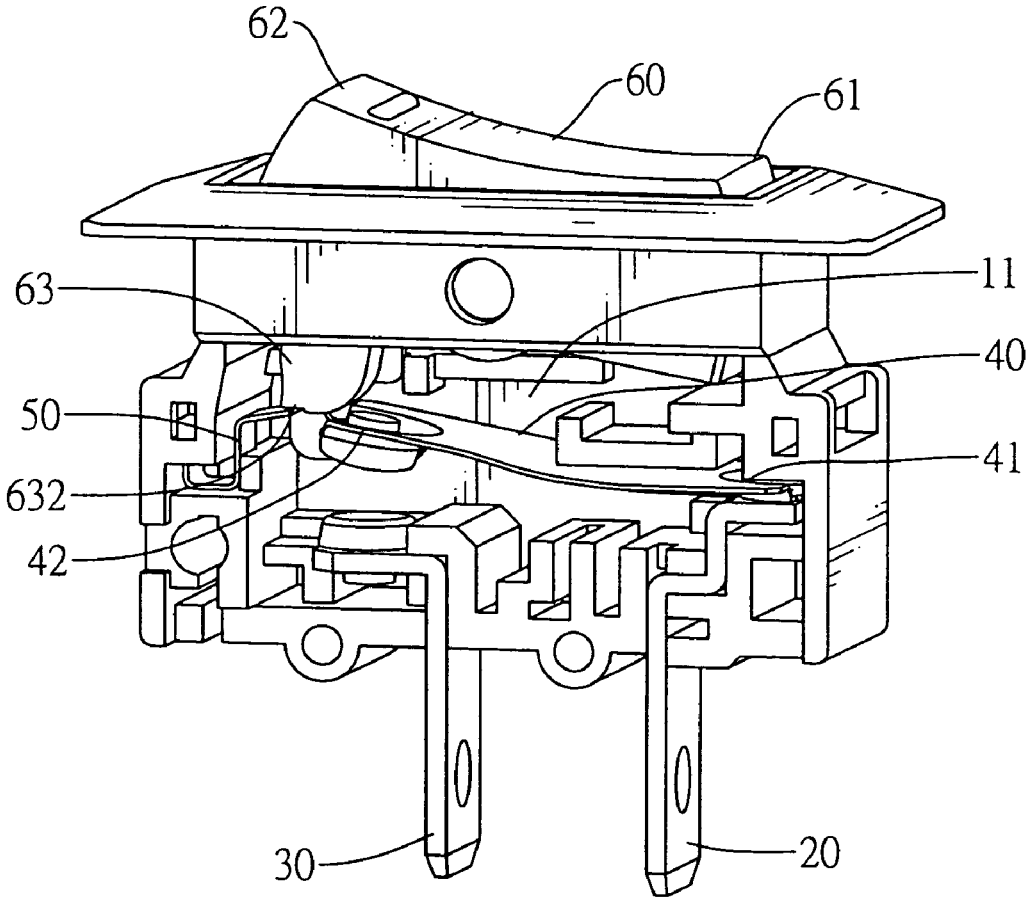
FIG. 4 is a perspective view of the safety in FIG. 1 with the activating end of the rocker pressed.
Figure 5:
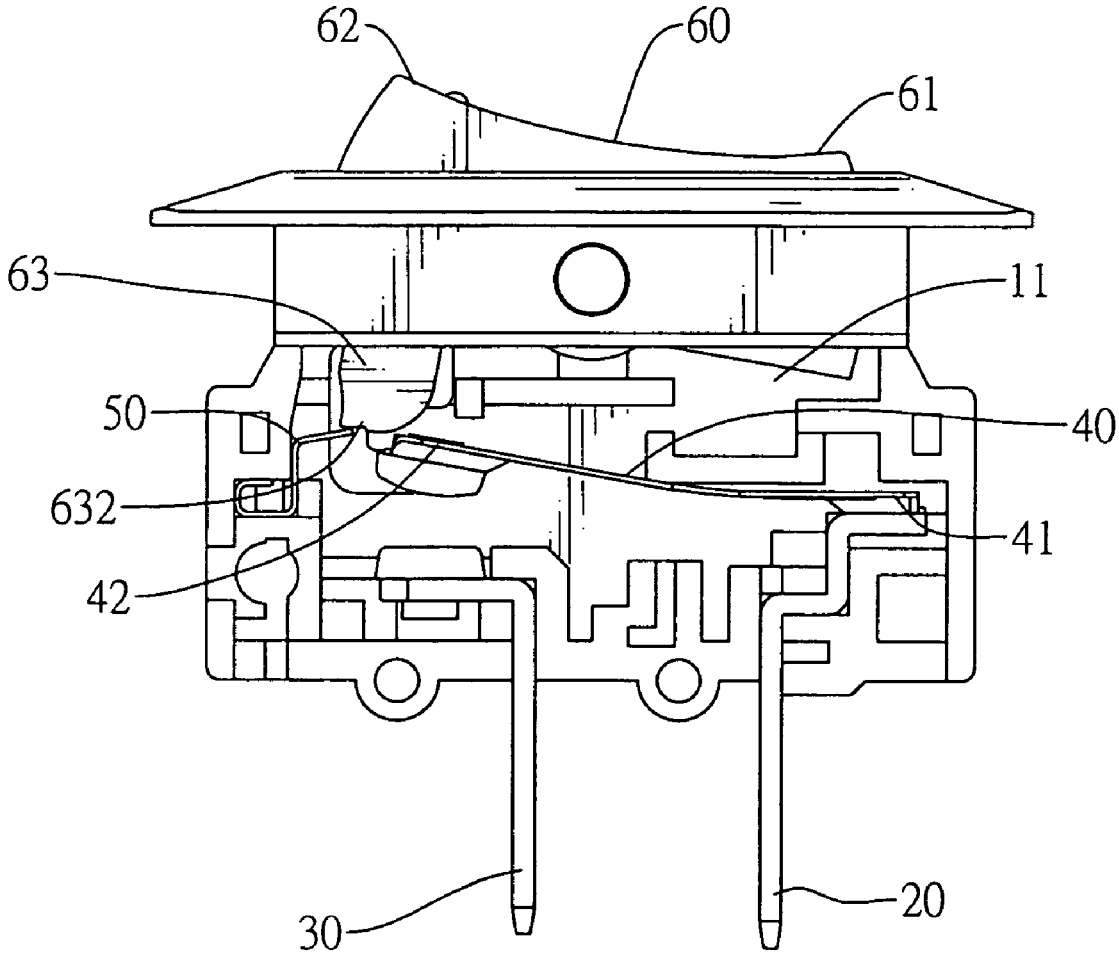
FIG. 5 is a side view of the safety switch in FIG. 5.
Figure 6:
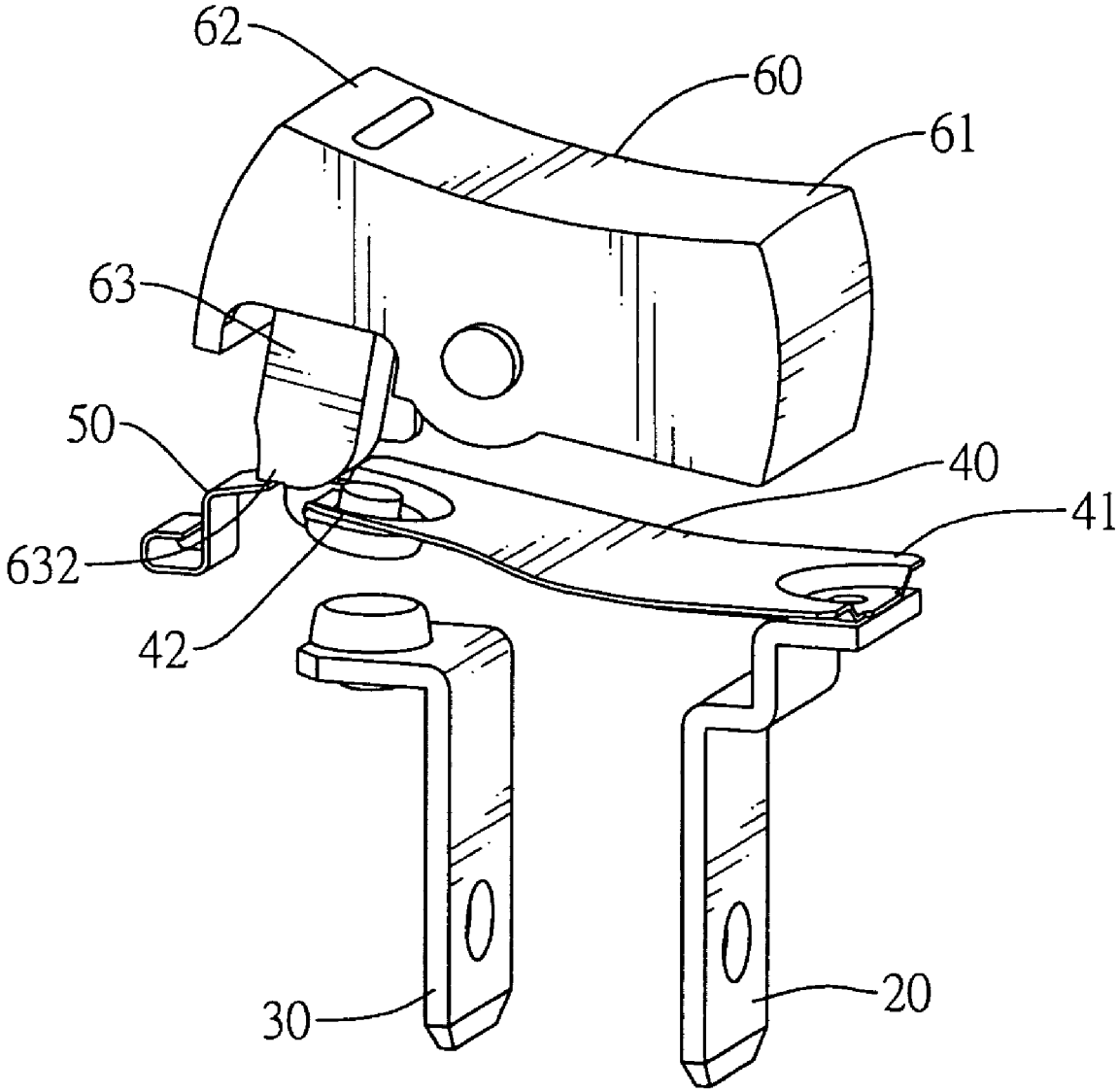
FIG. 6 is a perspective view of the safety switch in FIG. 5 without the casing.
Figure 7:
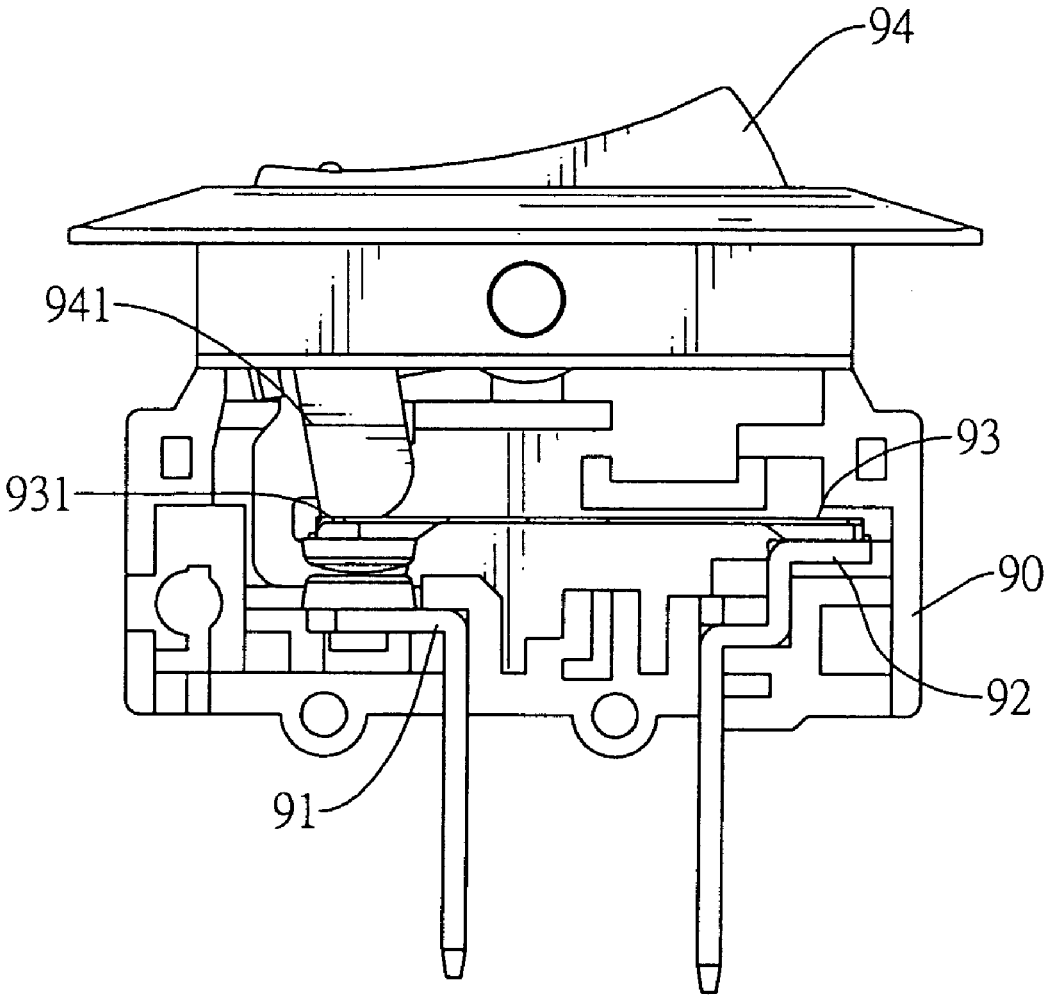
FIG.7 PRIOR ART
FIG. 7 is a side view of a conventional safety switch in accordance with prior art with the first end of the rocker pressed.
Figure 8:
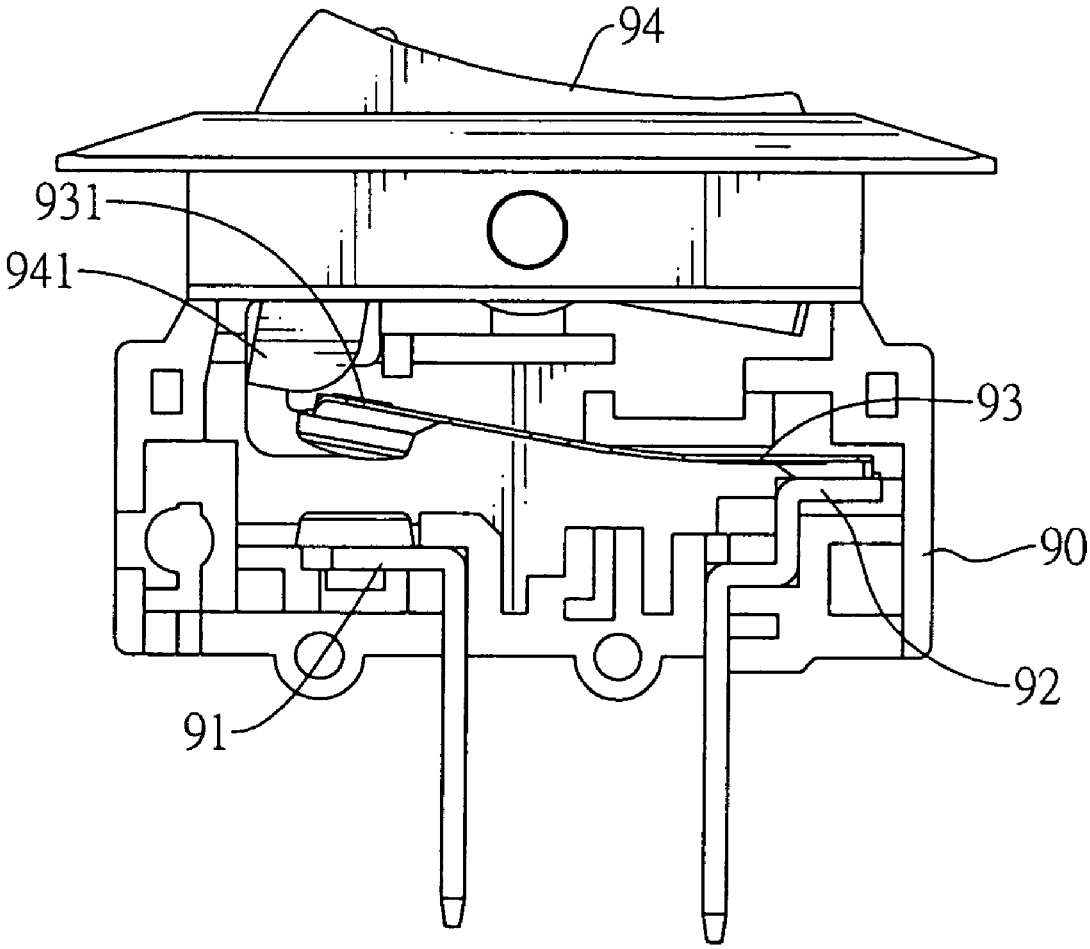
FIG.8 PRIOR ART
FIG. 8 is a side view of the conventional safety switch in FIG. 7 with the second end of the rocker pressed.

With further reference to FIGS. 4, 5 and 6, the latch (50) is flexible, is made of plastic, rubber or metal, is mounted securely in the cavity (11) and selectively locks the arm (63) to prevent the distal end (42) of the switch contact (40) from contacting the second circuit prong (30). The activating end (62) is pressed down, and the distal end (42) of the switch contact (40) contacts the second circuit prong (30) to activate the power-supplying circuit. When the deactivating end (61) of the rocker (62) is pressed, the activating end (62) rises from the top of the casing (10) and lifts the arm (63) and distal end (632) of the switch contact (40). The latch (50) engages the distal end (632) of the arm (63) and prevents the distal end (42) of the switch contact (40) from moving toward and contacting the second circuit prong (30). A deliberate force on the activating end (62) of the rocker (60) is required to force the latch (50) to bend and release the distal end (632) of the arm (63) so the distal end (42) of the switch contact (40) will contact the second circuit prong (30) and activate the power-supplying circuit.

Since the distal end (42) of the switch contact (40) is held away from the second circuit prong (30) even when the switch contact (40) has cooled and attempted to straighten, the safety switch may be used in severely cold environments Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety switch comprising:

a casing having a top;

a bottom; and a cavity being defined in the casing;

a first circuit prong being mounted in the cavity and extending through the bottom of the casing;

a second circuit prong mounted in the cavity and extending through the bottom of the casing parallel to the first circuit prong;

a switch contact bending upward as temperature of the switch contact increases, being attached to the first circuit prong and having a proximal end being attached securely on the first circuit prong; and a distal end selectively contacting or separating from the second circuit prong;

a rocker being mounted pivotally on the top of the casing and having a deactivating end;

an activating end; and an arm being formed on and protruding down from the activating end, extending through the top of the casing into the cavity and having a distal end connecting to the distal end of the switch contact, said arm having a receiving depression formed thereon; and a latch being flexible, mounted securely in the cavity and selectively locking the arm and preventing the distal end of the switch contact from contacting the second circuit prong, said latch having a planar leaf portion terminating in a free distal end, said planar leaf portion selectively engaging said receiving depression of said arm.

2. The safety switch as claimed in claim 1, wherein the switch contact is bimetallic.

3. The safety switch as claimed in claim 1, wherein the switch contact is material with memory.

4. The safety switch as claimed in claim 1, wherein the latch is plastic.

5. The safety switch as claimed in claim 1, wherein the latch is rubber.

6. The safety switch as claimed in claim 1, wherein the latch is metal.

7. The safety switch as claimed in claim 1, wherein the arm has a chamfered side.

8. The safety switch as claimed in claim 1, wherein the latch has a fixed end firmly coupled to the inner wall of said casing, an intermediate portion normal to said switch contact extending into said cavity, and a planar leaf portion connected to said intermediate portion on one end, said planar leaf portion being substantially parallel to said switch contact and terminating in a free distal end.

9. The safety switch as claimed in claim 8, wherein said switch contact is disposed longitudinally in said cavity and said planar leaf portion is angled slightly away from the longitudinal.

10. In a safety switch having a casing, a first circuit prong mounted in a cavity inside the casing and extending out of the casing, a second circuit prong mounted in the cavity and extending out of the casing to be parallel to the first circuit prong, a switch contact bending upward as temperature of the switch contact increases and having a proximal end attached securely on the first circuit prong and a distal end selectively contacting with the second circuit prong, a rocker pivotally mounted on top of the casing and having an arm protruding down from the bottom of the rocker to connect to the distal end of the switch contact, and a flexible latch mounted securely in the cavity and locking and preventing the distal end of the switch contact from contacting the second circuit prong, wherein the improvement comprises:

the latch is configured to have a fixed end adapted to be firmly connected to the casing, a vertical portion integrally extending from the fixed end and a latching end extending outward from a free end of the vertical portion and tilted upward relative to the vertical portion as well as the fixed end;

the arm is adapted to be integrally formed with the rocker and extending out of the bottom of the casing, the arm has an arcuate corner formed on a free end of the arm to selectively connect to the distal end of the switch contact and a hook formed on the free end of the arm and opposite to the arcuate corner, such that when the switch contact is bent due to the temperature increase of the switch contact, the distal end of the switch contact rises and connects to the arcuate corner of the arm so as to move the arm as well as the rocker to allow the latching end of the latch to engage with the hook and hold the rocker in position.

11. The safety switch improvement as claimed in claim 10, wherein the arm has a chamfered side.

12. The safety switch improvement as claimed in claim 10, wherein said arm has a receiving depression formed thereon for receiving said latch.

13. The safety switch as claimed in claim 10, wherein the switch contact is bimetallic.

14. The safety switch as claimed in claim 10, wherein the switch contact is material with memory.

15. The safety switch as claimed in claim 10, wherein the latch is plastic.

16. The safety switch as claimed in claim 10, wherein the latch is rubber.

17. The safety switch as claimed in claim 10, wherein the latch is metal.

* * * * *